US010435950B2

(12) United States Patent
Williams et al.

(10) Patent No.: US 10,435,950 B2
(45) Date of Patent: Oct. 8, 2019

(54) ROTARY TABLE DRIVE

(71) Applicant: Tulsa Winch, Inc., Jenks, OK (US)

(72) Inventors: Kirk Williams, Broken Arrow, OK (US); Shane Strahl, Jenks, OK (US)

(73) Assignee: Tulsa Winch, Inc., Jenks, OK (US)

( * ) Notice: Subject to any disclaimer, the term of this patent is extended or adjusted under 35 U.S.C. 154(b) by 191 days.

(21) Appl. No.: 15/384,917

(22) Filed: Dec. 20, 2016

(65) Prior Publication Data

US 2018/0171716 A1 Jun. 21, 2018

(51) Int. Cl.
*E21B 3/04* (2006.01)

(52) U.S. Cl.
CPC ..... *E21B 3/04* (2013.01)

(58) Field of Classification Search
CPC ..... E21B 3/04; E21B 7/02; E21B 19/164
USPC ..... 175/135, 195; 464/163, 165
See application file for complete search history.

(56) References Cited

U.S. PATENT DOCUMENTS 2,041,180 A 5/1936 Hodge et al.
2,182,935 A 12/1939 Whann
2,276,561 A 3/1942 Bloss
2,306,739 A 12/1942 Maier
2,891,771 A * 6/1959 Ashton ..... E21B 3/02 173/165
2,998,084 A * 8/1961 Johnson ..... E21B 3/04 173/140
3,282,339 A * 11/1966 Hasha ..... E21B 19/16 166/77.51
3,515,229 A * 6/1970 Casey, Sr. ..... E21B 3/04 173/151
3,570,610 A * 3/1971 Kehrberger ..... E21B 3/04 173/165
5,351,767 A * 10/1994 Stogner ..... E21B 19/16 175/162

OTHER PUBLICATIONS

International Search Report and Written Opinion for PCT/US2017/065779 dated Feb. 14, 2018.

* cited by examiner

*Primary Examiner* — Kenneth L Thompson
(74) *Attorney, Agent, or Firm* — David G. Woodral; GableGotwals

(57) ABSTRACT

A rotary table drive with a top plate and a bottom plate cooperating to define a bore and an adjacent sealed gear housing. A bushing adapter passes through the bore and is configured to receive a bushing to mate with a segment of polygonal drill pipe allowing rotational motion to be imparted thereto. The device includes a ring bearing having an inner ring affixed rigidly to the bushing adapter and an outer ring rigidly affixed to the bottom plate, and a drive gear within the sealed gear housing mated to the bushing adapter such that the bushing adapter is rotated in response to rotation of the drive gear. The bearing is sealed against exposure to the elements by being surrounded on all sides by a combination of the top plate, bottom plate, and bushing adapter.

12 Claims, 5 Drawing Sheets

ROTARY TABLE DRIVE

FIELD OF THE INVENTION

This disclosure relates to drilling rigs in general and, more particularly, to a sealed rotary table drive.

BACKGROUND OF THE INVENTION

Rotary drilling equipment used in oilfields absorbs a considerable amount of mistreatment and contamination. Such conditions on drilling platforms cause the equipment to fail at a rapid pace. Up until now, a rotary table drive included a series of bearings, gears, motors and plates stacked together to drive the drilling equipment or work string. This configuration allowed impurities to access the aforementioned parts. This contamination caused frequent damage, failures and shortened operational life. In turn, the constant replacement of these precision parts became quite costly. A more robust, longer lasting solution is necessary. What is needed is a system and method for addressing the above and related issues.

SUMMARY OF THE INVENTION

The invention of the present disclosure, in one aspect thereof, comprises a rotary table drive comprising having a top plate and a bottom plate cooperating to define a bore through both and an adjacent gear housing. A bushing adapter within the bore and defines a bushing adapter passage for receiving a bushing configured to mate with a segment of drill pipe allowing rotational motion to be imparted thereto. A ring bearing has an inner ring affixed rigidly to the bushing adapter and defines a plurality of teeth around a perimeter thereof. An outer ring of the bearing is rigidly affixed to the bottom plate. The gear housing receives output from a motor for imparting rotary motion to the bushing adapter via the teeth on the ring bearing and the bearing is sealed against exposure to the elements by being surrounded on all sides by a combination of the top plate, bottom plate, and bushing adapter.

In some embodiments the bushing adapter comprises an upper portion that rotates at least partially above the top plate and a lower portion that proceed from the upper portion downwardly through the bore. The upper portion and lower portion may be a monolithic whole or the upper portion and lower portion may be separate components integrated during assembly of the rotary table drive. A plurality of braking notches may be defined in the upper portion of the bushing adapter.

In some embodiments, an upper main seal interposes the bushing adapter and the top plate, and a lower main seal interposes the inner ring of the bearing and the bottom plate. The device may include a motor having an output shaft affixed to a drive gear inside the gear housing. The motor may be sealed to the bottom plate. In some cases an idler gear is sealed within the gear housing and interposes the drive gear and the teeth of the inner ring of the bearing for transferring rotary forces between the two.

The invention of the present disclosure, in another aspect thereof, comprises a rotary table drive with a top plate and a bottom plate cooperating to define a bore and an adjacent sealed gear housing. A bushing adapter passes through the bore and is configured to receive a bushing to mate with a segment of polygonal drill pipe allowing rotational motion to be imparted thereto. The device includes a ring bearing having an inner ring affixed rigidly to the bushing adapter and an outer ring rigidly affixed to the bottom plate, and a drive gear within the sealed gear housing mated to the bushing adapter such that the bushing adapter is rotated in response to rotation of the drive gear. The bearing is sealed against exposure to the elements by being surrounded on all sides by a combination of the top plate, bottom plate, and bushing adapter.

The rotary table drive may further comprise a sealed motor that is sealed to the bottom plate with an output shaft mated to the drive gear. The bearing may define a plurality of gear teeth on the inner ring through which rotary motion is imparted to the bushing adapter. An idler gear may interpose the drive gear and the gear teeth of the inner ring.

In some embodiments, a plurality of braking notches is defined in an upper portion of the bushing adapter, superior to the top plate. An upper main seal may interpose the upper portion of the bushing adapter and the top plate. A lower main seal may interpose the inner ring of the bearing and the lower plate.

The invention of the present disclosure, in another aspect thereof, comprises a method including providing an upper and lower plate defining a gear housing and an adjacent bore, providing a bushing adapter through the bore riding on a ring bearing sandwiched between the upper and lower plate, and driving the bushing adapter in a rotating fashion via a drive gear contained in the gear housing and affixed to a sealed motor outside the gear housing.

The method may include driving the bushing adapter via an idler gear interposing the drive gear and a plurality of teeth defined on an inner ring of the bearing, which is rigidly affixed to the bushing adapter. The method may include defining a plurality of braking notches in an upper portion of the bushing adapter that rotates through a plane superior to the upper plate. The upper portion of the bushing adapter may be sealed where it mates against the upper plate.

DETAILED DESCRIPTION OF THE PREFERRED EMBODIMENTS

Figure 1:
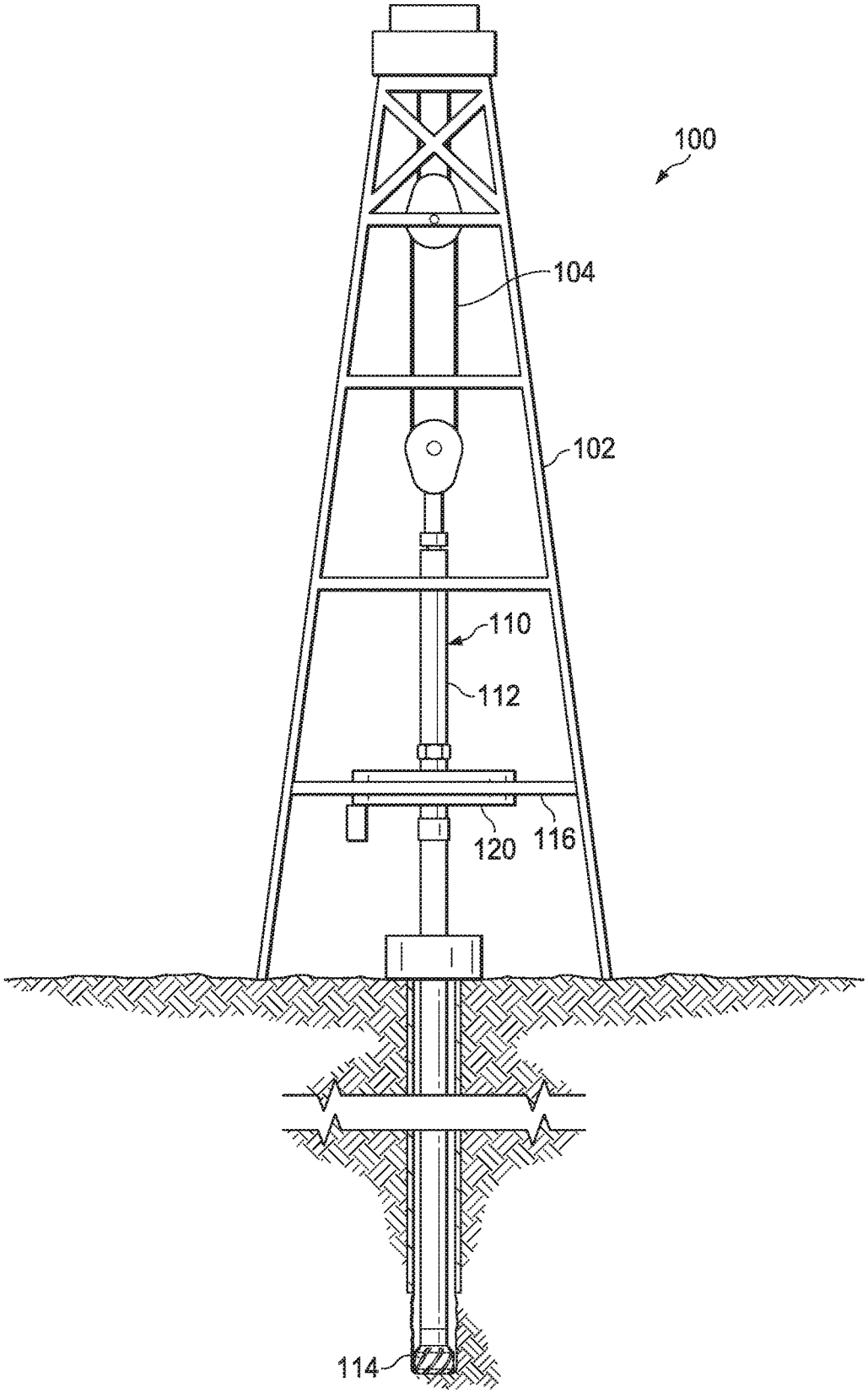
FIG. 1 is a simplified side view of a typical drilling rig.

Referring now to FIG. 1, a simplified side view of a typical drilling rig 100 is shown. FIG. 1 is simplified in that not all parts or components that may be present at a drilling rig site are shown. As shown, the exemplary drilling rig 100 may include a derrick 102 used to support working components relative to the ground surface and well bore. The rig 100 may include a crane or pulley system 104 for manipulating a workstring 110. The workstring 110 may include various segments of drill pipe 112, a bit 114, and/or various other tools and components. The derrick 102 may include a drill floor 116 or platform into which is mounted a rotary table drive 120. The rotary table drive 120 is configured to impart a rotary motion to the drill pipe 112 and/or workstring 110.

Figure 2:
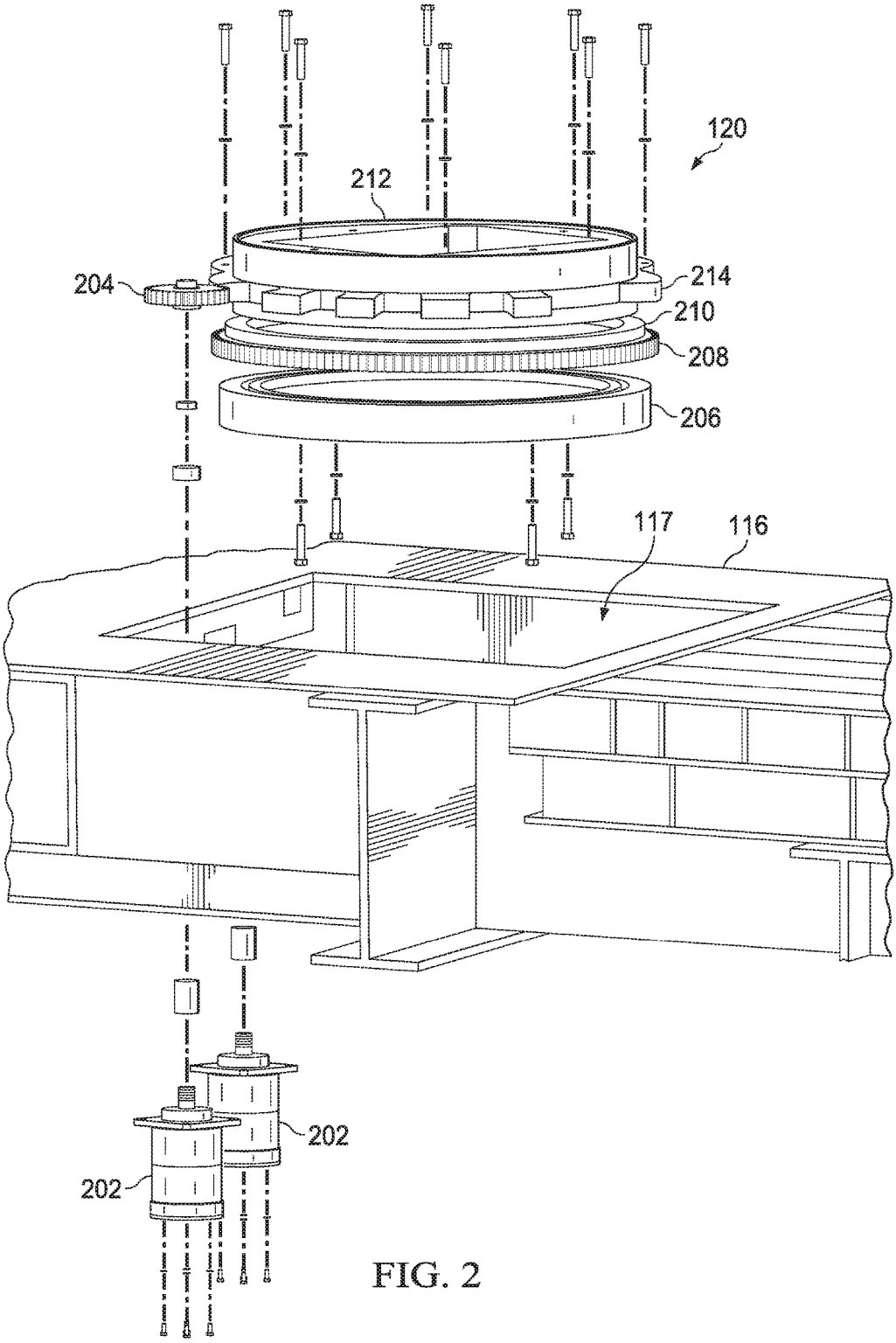
FIG. 2 is an exploded view of a rotary table drive.

Referring now to FIG. 2, an exploded view of the rotary table drive 120 is shown. Here, a portion of the drill floor 116 can also been seen in perspective and can be seen to define an opening or aperture 117 into which the rotary table drive 120 may be mounted. A typical rotary table drive 120 may include a plurality of drive motors 202 engaging the remainder of the rotary table drive 120 via one or more drive gears 204.

The rotary table drive 120 includes a primary bearing or mounting plate 206 that may be rigidly affixed to the drill floor 116. The bearing 206 allows for rotation of a bushing adapter 212 relative to the drill floor 116 and the rest of the derrick 102. The bushing adapter 212 is also configured to receive a bushing (not shown) that fits precisely with the outer contour of the adjacent section of the drill pipe to part rotational motion thereto. The drill pipe 112 may be splined or have a polygonal outer surface mating with the inner surface of the bushing to allow the pipe to be rotated by the rig 100. Such an arrangement is known in the art as a "Kelly Drive."

Drive power to the bushing adapter 212 is provided by the drive motors 202 affixed to the drive gears 204. The drive gears 204 interfit with a ring gear 208 that is rigidly affixed to the bushing adapter 212. Also included as part of the rotary table drive 120 may be a notched plate 214 that is rigidly affixed to the bushing adapter 212 such that it may be used as a breaking or holding device for the rotary table drive 120.

It may be appreciated that while a Kelly Drive system as described herein is effective at powering or rotating the workstring 110, the complex arrangement and stacking of parts increases materials and construction costs. The exposed nature of the moving components such as the bearings, motors, and gear train promotes increased and early wear in the harsh environment of a drilling rig. Break downs are common, which results in added expenses not only in repairing or replacing the rotary table drive 120, but also in down time for the rig 100 itself.

Figure 3:
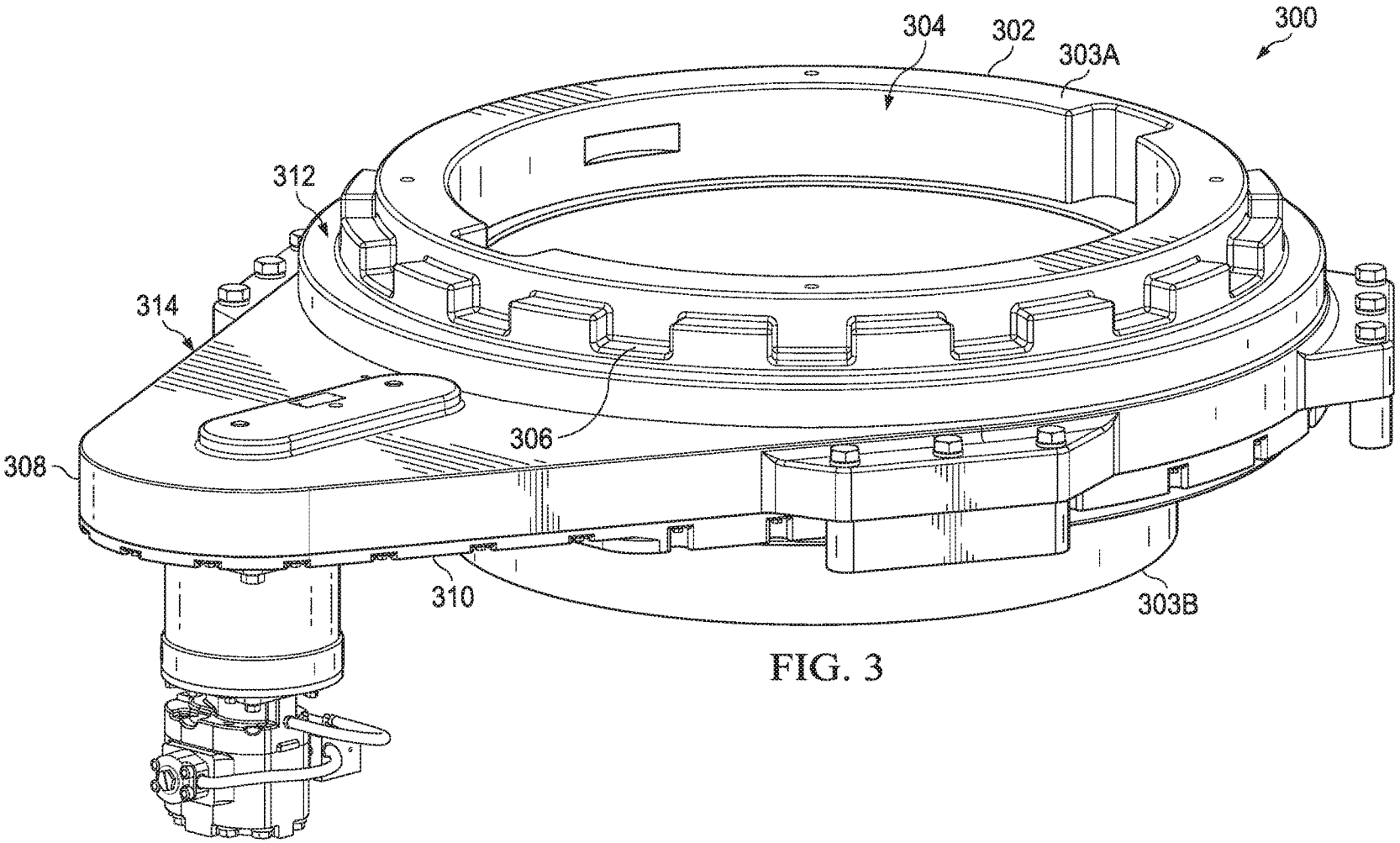
FIG. 3 is a perspective view of a rotary table drive according to aspects of the present disclosure.

Referring now to FIG. 3, a perspective view of a rotary table drive 300 according to aspects of the present disclosure is shown. The rotary table drive 300, in various embodiments, is a replacement for the rotary table drive 120 (FIG. 2). The rotary table drive 300 may be configured as a "drop in" replacement such that substantial reconfiguration or redesign of the associated derrick or rig is not needed. In addition to providing functionality and operation similar to the rotary table drive 120 the rotary table drive 300 operates with a reduced and more robust set of components. The gear train, bearings, and other components of the rotary table drive 300 are also sealed against contamination and wear resulting from the environment of the drilling rig 100.

Figure 4:
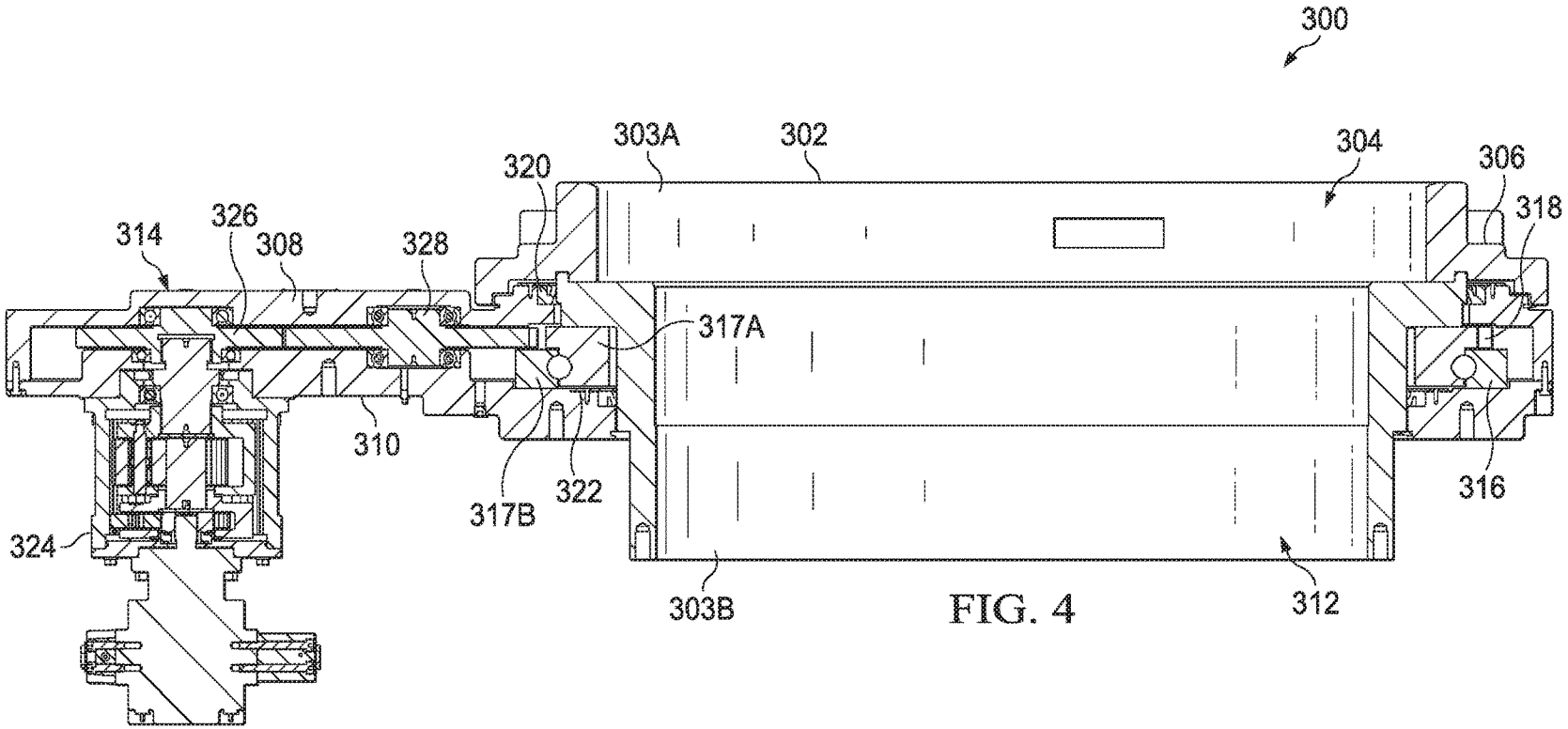
FIG. 4 is a side cutaway view of the rotary table drive of FIG. 3.
Figure 5:
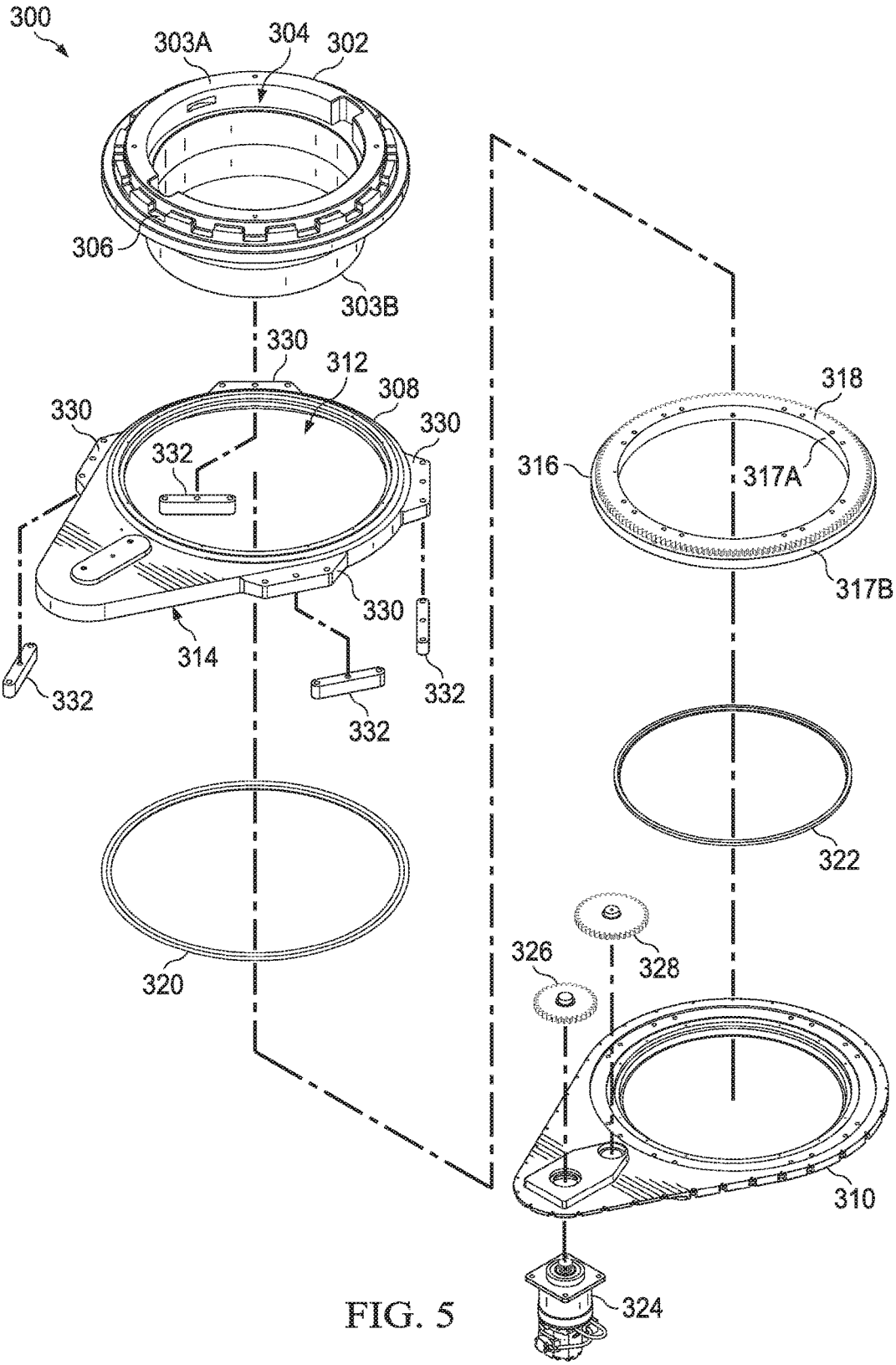
FIG. 5 is an exploded view of the rotary table drive of FIG. 3.

The rotary table drive 300 may best be appreciated by additional reference to FIG. 4, which is a side cutaway view of the rotary table drive 300, and to FIG. 5, which is an exploded view of the same. Rotary table drive 300 includes a bushing adapter 302 that may receive a bushing (not shown) having a shape cooperating with the workstring 110 or drill pipe 112 to allow rotational movement thereof to be imparted. In this respect, the rotary table drive 300 may also form a part of a Kelly Drive system.

The bushing adapter 302 defines a bore 304 that receives the Kelly bushing and provides for passage of the workstring 110, including the current section of drill pipe 112 and bit 114 when necessary. The bushing adapter 302 may comprise a single monolithic piece that may be forged or machined into the appropriate shape. In other embodiments the bushing adapter 302 may comprise an upper portion 303A mated to lower portion 303B. In some instances, the bushing adapter being provided in upper and lower components 303A and 303B, respectively, may allow for easier assembly of the finished rotary table drive 300.

The bushing adapter 302 may include a plurality of circumferentially-spaced brake notches 306 defined in the upper portion 303A. The brake notches 306 eliminate the need for a separate notched plate 214 as described previously. As the braking function of the rotary table drive 300 may be provided by components external to the rotary table drive 300 itself, the brake notches 306 remain available on the outside of the rotary table drive 300. The brake notches 306 defined by the bushing adapter 302 remain on top of a top plate 308 that, in conjunction with a bottom plate 310, provides a sealed cavity for certain critical components of the rotary table drive 300.

The top plate 308 and the bottom plate 310 define a bushing adapter passage 312 through which the bushing adapter proceeds, as may be readily appreciated in FIGS. 3 and 4. Adjacent to the bushing adapter passage 312 is a gear housing 314 defined as a cavity between the top plate 308 and bottom plate 310. It should be understood that where the top plate 308 meets the bottom plate 310 seals, gaskets or other dirt and fluid excluding devices may be utilized.

A bearing 316 may be affixed to the bottom plate 310 as well as the bushing adapter 302 such that rotation is allowed between these two components. In some embodiments, the bearing 316 is of the slew ring type. An inner ring 317A may be rigidly affixed to the bushing adapter 302 while an outer ring 317B is rigidly affixed to the bottom plate 310. The bearing 316 integrates a gear plate 318 on the inner ring 317A such that a separate ring gear 218 is not needed. The gear plate 318 may be machined or formed in the surface of the bearing 316 and may comprise a plurality of outward facing teeth on or near the perimeter of the bearing 316 or inner ring 317A of the bearing 316. Since the bearing 316 is affixed rigidly to the bushing adapter 302, rotational movement may be imparted to the bushing adapter 302 via the integrated gear plate 318.

Where the bushing adapter 302 fits onto or mates with the top plate 308, an upper main seal 320 may be provided. Where the bearing 316 affixes to or mates with the bottom plate 310, a lower main seal 322 may be provided. In this way the bearing 316, which may be prone to premature wear and failure via dirt or fluid contamination, is completely sealed within the rotary table drive 300. The bearing 316 thus interfaces only with the bottom plate 310, the top plate 308 and that portion of the bushing adapter 302 that is in between the top plate 308 and bottom plate 310.

A single drive motor 324 may be rigidly affixed to the bottom plate 310 proximate the gear housing 314. The drive motor 324 may be of a sealed design to further insulate it from fouling, contamination, and premature failure. The drive motor 324 may be hydraulically or electrically powered. An output shaft of the motor 324 may be fitted to a drive gear 326 that is entirely sealed within the gear housing 314. In some embodiment an idler gear 328 may also be mounted via bearings inside the gear housing 314 and provide for the drive motor 324 to be mounted to the bottom plate 310 with an appropriate clearance for the rotating bushing adapter 302 and workstring 110. The drive gear 326 cooperates and drives the idler gear 328 which interfits with and drives the integrated gear plate 318 of the bearing 316. In other embodiments, no idler gear may be present such that the motor 324 drives the gear plate 318 directly, but such a configuration reduces the clearance between the motor 234 and workstring occupying the bore 304. It should be understood that various bearing and seals may be utilized within the gear housing 314 where appropriate. For example, a seal may be provided where the motor 324 fits to the bottom plate and the drive gear 326 and/or idler gear 328 may ride upon bearings within the gear housing 314.

Various features may be provided on the top plate 308 and/or bottom plate 310 that allow for the rotary table drive 300 to be suitably mounted to the drill floor 116 or other portion of the derrick 102 without compromising the integrity of the sealed portions of the rotary table drive 300. Here a number of mounting supports 330 are provided near the parameter of the bushing adapter passage 312 on the top plate 308. The mounting supports 330 may be located roughly evenly spaced circumferentially placed about the bushing adapter passage 312. In other embodiments more or fewer mounting supports 330 may be utilized. Fastener plates 332 may be provided for each of the mounting supports 330 to distribute forces from fasteners (not shown) used to mount the rotary table drive in place.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%.

When, in this document, a range is given as "(a first number) to (a second number)" or "(a first number)-(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Further, it should be noted that terms of approximation (e.g., "about", "substantially", "approximately", etc.) are to be interpreted according to their ordinary and customary meanings as used in the associated art unless indicated otherwise herein. Absent a specific definition within this disclosure, and absent ordinary and customary usage in the associated art, such terms should be interpreted to be plus or minus 10% of the base value.

Thus, the present invention is well adapted to carry out the objects and attain the ends and advantages mentioned above as well as those inherent therein. While the inventive device has been described and illustrated herein by reference to certain preferred embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

What is claimed is:

1. A rotary table drive comprising:

a top plate and a bottom plate cooperating to define a bore through both and an adjacent gear housing;

a bushing adapter within the bore and defining a bushing adapter passage for receiving a bushing configured to mate with a segment of drill pipe allowing rotational motion to be imparted thereto;

a ring bearing having an inner ring affixed rigidly to the bushing adapter and defining a plurality of teeth around a perimeter thereof, and an outer ring rigidly affixed to the bottom plate; and a plurality of braking notches defined in the upper portion of the bushing adapter;

wherein the gear housing receives output from a motor for imparting rotary motion to the bushing adapter via the teeth on the ring bearing;

wherein the bearing is sealed against exposure to the elements by being surrounded on all sides by a combination of the top plate, bottom plate, and bushing adapter;

wherein the bushing adapter comprises an upper portion that rotates at least partially above the top plate and a lower portion that proceed from the upper portion downwardly through the bore; and wherein the upper portion and lower portion are a monolithic whole.

2. The rotary drive of claim 1, further comprising a motor having an output shaft affixed to a drive gear inside the gear housing.

3. The rotary drive of claim 2, wherein the motor is sealed to the bottom plate.

4. The rotary drive of claim 2, further comprising an idler gear sealed within the gear housing and interposing the drive gear and the teeth of the inner ring of the bearing for transferring rotary forces between the two.

5. A rotary table drive comprising:

a top plate and a bottom plate cooperating to define a bore through both and an adjacent gear housing;

a bushing adapter within the bore and defining a bushing adapter passage for receiving a bushing configured to mate with a segment of drill pipe allowing rotational motion to be imparted thereto;

a ring bearing having an inner ring affixed rigidly to the bushing adapter and defining a plurality of teeth around a perimeter thereof, and an outer ring rigidly affixed to the bottom plate;

an upper main seal interposing the bushing adapter and the top plate; and a lower main seal interposing the inner ring of the bearing and the bottom plate wherein the gear housing receives output from a motor for imparting rotary motion to the bushing adapter via the teeth on the ring bearing; and wherein the bearing is sealed against exposure to the elements by being surrounded on all sides by a combination of the top plate, bottom plate, and bushing adapter.

6. A rotary table drive comprising:

a top plate and a bottom plate cooperating to define a bore and an adjacent sealed gear housing;

a bushing adapter passing through the bore and configured to receive a bushing to mate with a segment of polygonal drill pipe allowing rotational motion to be imparted thereto;

a ring bearing having an inner ring affixed rigidly to the bushing adapter and an outer ring rigidly affixed to the bottom plate; and a drive gear within the sealed gear housing mated to the bushing adapter such that the bushing adapter is rotated in response to rotation of the drive gear;

a sealed motor sealed to the bottom plate and having an output shaft mated to the drive gear; and an idler gear interposing the drive gear and the gear teeth of the inner ring;

wherein the bearing is sealed against exposure to the elements by being surrounded on all sides by a combination of the top plate, bottom plate, and bushing adapter; and wherein the bearing defines a plurality of gear teeth on the inner ring through which rotary motion is imparted to the bushing adapter.

7. The rotary table drive of claim 6, further comprising a plurality of braking notches defined in an upper portion of the bushing adapter, superior to the top plate.

8. The rotary table drive of claim 7, further comprising an upper main seal interposing the upper portion of the bushing adapter and the top plate.

9. The rotary table drive of claim 8, further comprising a lower main seal interposing the inner ring of the bearing and the lower plate.

10. A method comprising:

providing an upper and lower plate defining a gear housing and an adjacent bore;

providing a bushing adapter through the bore riding on a ring bearing sandwiched between the upper and lower plate; and driving the bushing adapter in a rotating fashion via a drive gear contained in the gear housing and affixed to a sealed motor outside the gear housing; and driving the bushing adapter via an idler gear interposing the drive gear and a plurality of teeth defined on an inner ring of the bearing, which is rigidly affixed to the bushing adapter.

11. The method of claim 10, further comprising defining a plurality of braking notches in an upper portion of the bushing adapter that rotates through a plane superior to the upper plate.

12. The method of claim 11, further comprising sealing the upper portion of the bushing adapter where it mates against the upper plate.

* * * * *